US009087510B2

(12) United States Patent
Lee

(10) Patent No.: US 9,087,510 B2
(45) Date of Patent: Jul. 21, 2015

(54) METHOD AND APPARATUS FOR DECODING SPEECH SIGNAL USING ADAPTIVE CODEBOOK UPDATE

(75) Inventor: Mi-Suk Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 98 days.

(21) Appl. No.: 13/876,768

(22) PCT Filed: Sep. 28, 2011

(86) PCT No.: PCT/KR2011/007150

§ 371 (c)(1),
(2), (4) Date: Mar. 28, 2013

(87) PCT Pub. No.: WO2012/044067

PCT Pub. Date: Apr. 5, 2012

(65) Prior Publication Data

US 2013/0246068 A1 Sep. 19, 2013

(30) Foreign Application Priority Data

Sep. 28, 2010 (KR) ..... 10-2010-0093874
Sep. 27, 2011 (KR) ..... 10-2011-0097637

(51) Int. Cl.
*G10L 19/005* (2013.01)
*G10L 19/09* (2013.01)

(52) U.S. Cl.
CPC ..... *G10L 19/005* (2013.01); *G10L 19/09* (2013.01)

(58) Field of Classification Search
None
See application file for complete search history.

(56) References Cited

U.S. PATENT DOCUMENTS

| | | | | |
|---|---|---|---|---|
| 5,699,478 | A * | 12/1997 | Nahumi | 704/226 |
| 5,732,389 | A | 3/1998 | Kroon et al. | |
| 6,775,649 | B1 * | 8/2004 | DeMartin | 704/201 |
| 6,782,360 | B1 | 8/2004 | Gao et al. | |
| 2005/0049853 | A1 * | 3/2005 | Lee et al. | 704/201 |
| 2007/0136054 | A1 | 6/2007 | Kim et al. | |

(Continued)

FOREIGN PATENT DOCUMENTS

| | | | |
|---|---|---|---|
| KR | 1020030001523 | A | 1/2003 |
| KR | 1020070061193 | A | 6/2007 |
| KR | 1020080011186 | A | 1/2008 |

(Continued)

OTHER PUBLICATIONS

"Efficient Frame Erasure Concealment in Predictive Speech Codecs Using Clottal Pulse Resynchronisation" by Tommy Vaillancourt et al. ICASSP 2007.*

(Continued)

*Primary Examiner* — Jialong He
*Assistant Examiner* — Yi-Sheng Wang
(74) *Attorney, Agent, or Firm* — William Park & Associates Ltd.

(57) ABSTRACT

Disclosed are a method and apparatus for decoding a an audiospeech signal using an adaptive codebook update. The method for decoding speech an audio signal includes: receiving an N+1-th normal frame data that is a normal frame transmitted after an N-th frame that is a loss frame data loss; determining whether an adaptive codebook of a final subframe of the N-th frame is updated or not by using the N-th frame and the N+1-th frame; updating the adaptive codebook of the final subframe of the N-th frame by using a the pitch index of the N+1-the frame; and synthesizing an audio a speech signal of by using the N+1-th frame.

8 Claims, 4 Drawing Sheets

(56) References Cited

U.S. PATENT DOCUMENTS

2009/0276212 A1 11/2009 Khalil et al.
2010/0312553 A1* 12/2010 Fang et al. ..... 704/226

FOREIGN PATENT DOCUMENTS

KR 1020080080235 A 9/2008
WO 2007073604 A1 7/2007

OTHER PUBLICATIONS

Juan Carlos De Martin et al., "Improved Frame Erasure Concealment for Celp-Based Coders", ICASSP2000 vol. 3 pp. 1483-1486, Jun. 2000.

* cited by examiner

METHOD AND APPARATUS FOR DECODING SPEECH SIGNAL USING ADAPTIVE CODEBOOK UPDATE

CROSS-REFERENCE(S) TO RELATED APPLICATIONS

The present application claims priority of Korean Patent Application Nos. 10-2010-0093874 and 10-2011-0097637, filed on Sep. 28, 2010, and Sep. 27, 2011, respectively, which are incorporated herein by reference in their entirety.

BACKGROUND OF THE INVENTION

1. Field of the Invention

Exemplary embodiments of the present invention relate to a method and an apparatus for decoding a speech signalT and more particularly, to a method and an apparatus for decoding a speech signal using adaptive codebook update.

2. Description of Related Art

The encoder and decoder are required for a speech(audio) communication. The encoder compresses a digital speech signal and the decoder reconstructs a speech signal from the encoded frame data. One of the most widely used speech coding (encoder and decoder) technologies is the code excited linear prediction (CELP). The CELP codec represents the speech signal with a synthesis filter and an excitation signal of that filter.

A representative example of the CELP codec may include a G.729 codec and an adaptive multi-rate (AMR) codec. Encoders of these codecs extract synthesis filter coefficients from an input signal of one frame corresponding to 10 or 20 msec and then divide the frame into several subframes of 5 msec. And it obtains pitch index and gain of the adaptive codebook and pulse index and gain of the fixed codebook in each subframe. The decoder generates an excitation signal using the pitch index and gain of the adaptive codebook and the pulse index and gain of the fixed codebook and filters this excitation signal using the synthesis filter, thereby reconstructing speech signal.

A frame data loss may occurs according to the condition of communication network during the transmission of the frame data which is an output of the encoder. In order to reduce a quality degradation of the decoded signal of the lost frame, a frame loss concealment algorithm is required. Most of the frame loss concealment algorithms recover the signal of the lost frame by using a normal frame data which received without loss just before the frame data loss. However, the quality of the normally decoded frame just after the frame data loss is also effected by the influence of the lost frame. And the frame data loss causes quality degradation of the normal frame as well as lost frame. Therefore, not only the frame loss concealment algorithm for a lost frame but also fast recovering algorithm for a normal frame received just after the frame loss is required.

SUMMARY OF THE INVENTION

An embodiment of the present invention is directed to provide a method and an apparatus for decoding a speech signal capable of more rapidly returning to a normal state by updating an adaptive codebook of a last sub frame of the lost frame using a normally received frame data after a frame data loss.

The objects of the present invention are not limited to the above-mentioned objects and therefore, other objects and advantages of the present invention that are not mentioned may be understood by the following description and will be more obviously understood by exemplary embodiments of the present invention.

A method for decoding a speech signal includes: receiving an N+1-th normal frame data which is received after an N-th frame data loss; determining whether an adaptive codebook of a final sub frame of the N-th frame is updated by using the parameter of the N-th frame and N+1-th frame; updating the adaptive codebook of the final subframe of the N-th frame by using the parameter of the N+1-the frame; and synthesizing a speech signal of the N+1-th frame.

An apparatus for decoding a speech signal includes: an input unit receiving an N+1-th frame data that is a normally received frame after a loss of N-th frame data; a control, unit determining whether an adaptive codebook of a final subframe of the N-th frame is updated by using the parameter of N-th frame and N+1-th frame; unit updating the adaptive codebook of the final subframe of the N-th frame by using the parameter of N+1-the frame; and a decoding unit synthesizing an speech signal of the N+1-th frame.

DESCRIPTION OF SPECIFIC EMBODIMENTS

Exemplary embodiments of the present invention will foe described below in more detail with reference to the accompanying drawings. Only portions needed to understand an operation in accordance with exemplary embodiments of the present invention will be described in the following description. It is to be noted that descriptions of other portions will be omitted so as not to make the subject matters of the present invention obscure.

Figure 1:
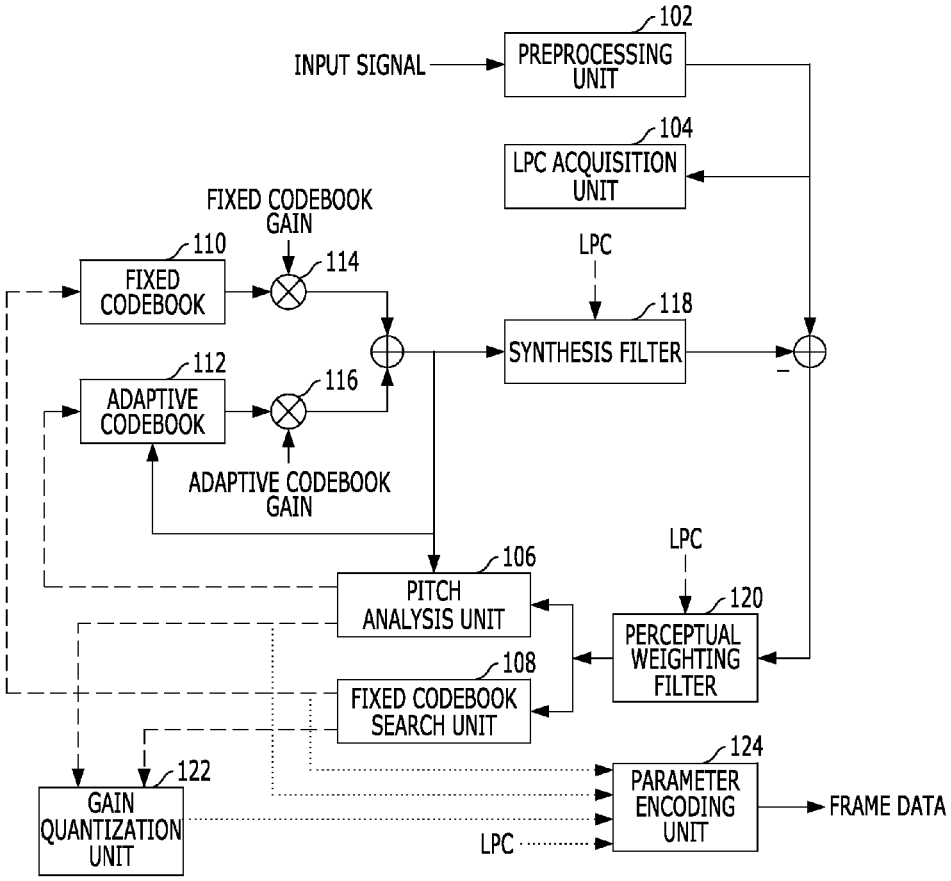
FIG. 1 is a diagram illustrating a configuration of a CELP encoder.

FIG. 1 is a diagram illustrating a configuration of a CELP encoder.

A preprocessing unit 102 down scales an one frame of input signal and performs high pass filtering. In this case, the length of one frame could be 10 msec or 20 msec and is comprised of serveral subframes. Generally, the length of the sub frame is 5 msec.

An LPC acquisition unit 104 extracts a linear prediction coefficient (LPC) corresponding to a synthesis filter coefficient from the preprocessed signal. Then, the LPC acquisition unit 104 quantizes the extracted LPC and interpolates the unquantised LPC with that of the previous frame to get the synthesis filter coefficients of each subframe.

A pitch analysis unit 106 find pitch index and gain of an adaptive codebook in every subframe. The acquired pitch index is used to reproduce an adaptive codebook from an adaptive codebook module 112. Further, a fixed codebook search unit 108 finds a pulse index and gain of a fixed codebook in every subframe. The acquired pulse index is used to reproduce the fixed codebook from a fixed codebook module 110. The adaptive codebook gain and the fixed codebook gain are quantized by a gain quantization unit 122.

An output of a fixed codebook module 110 is multiplied by a fixed codebook gain 114. An output of the adaptive codebook module 112 is multiplied by an adaptive codebook gain 116. An excitation signal is constructed by adding the adaptive codebook and the fixed codebook that are multiplied by each gain. And the excitation signal is filtered with synthesis filter 118.

Thereafter, an error between the preprocessed signal 102 and the output signal of the synthesis filter 118 is filtered by a perceptual weighting filter 120 which reflecting human auditory characteristics and then, the pitch index and gain and the pulse index and gain which minimize the error are finally selected. Then the obtained index and gain, are transmitted to a parameter encoding unit 124. The parameter encoding unit 124 output a frame data which are comprised of the pitch index, the pulse index, the output of the gain quantization unit 122 and LPC parameter. The output frame data are transmitted to a decoder through a network, or the like.

Figure 2:
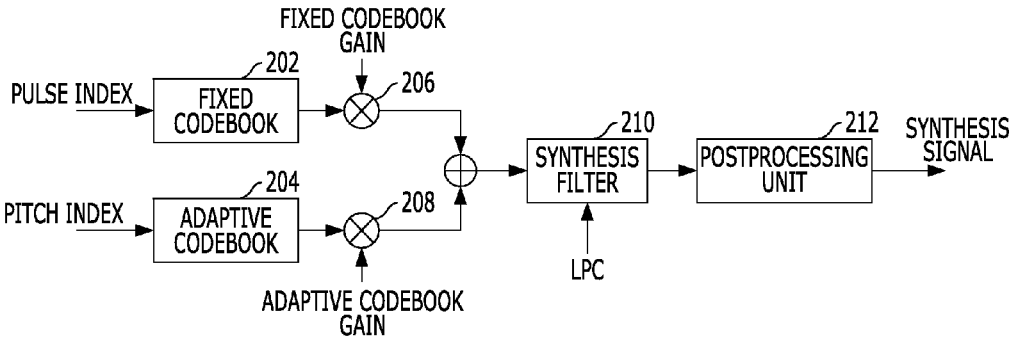
FIG. 2 is a diagram illustrating a configuration a CELP decoder.

FIG. 2 is a diagram illustrating a configuration of a CELP decoder.

The decoder constructs a fixed codebook 202 and an adaptive codebook 204 by using the pulse index and pitch index. Then, the output of the fixed codebook 202 is multiplied by the fixed codebook gain (206) and the output of the adaptive codebook 204 is multiplied by the adaptive codebook gain (208). The excitation signal is recovered by adding the adaptive codebook and the fixed codebook that are multiplied by each gain. The recovered excitation signal is filtered by the synthesis filter 210 whose coefficients are obtained by interpolating the LPC coefficient transmitted from encoder. In order to get improved signal quality, the output signal of the synthesis filter 210 is post-processed in a post-processing unit 212.

Meanwhile, the frame data loss may occur according to a network condition while the output frame data of encoder in FIG. 1 are transmitted to the decoder in FIG. 2. As a result, the frame data loss cause a quality degradation of the synthesized speech signal in the decoder. In order to reduce the quality degradation caused by the frame data loss, most of the codecs embedded a frame loss concealment algorithm.

In case of an adaptive multirate-wideband (AMR-WB) codec, the signal of the lost frame are recovered by using the scaled parameters of the previous normal frame received just before frame data loss. Where, the scale value are determined according to a continuity of frame loss.

Figure 3:
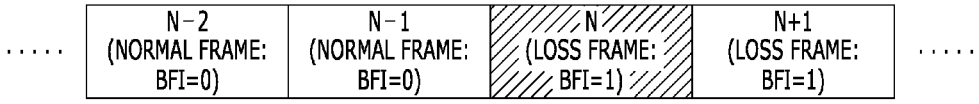
FIG. 3 is a frame sequence transmitted from an encoder to a decoder.

For example, as illustrated in FIG. 3, when an N−1-th frame data is normally received, but an M-th frame data is lost during the transmission, the AMR-WB decoder recover the signal of lost frame as follow. First recover the synthesis filter coefficient of the N-th frame by using the synthesis filter coefficient of the N−1-th frame. Further, the fixed codebook is recovered using a random function and the fined codebook gain is reconstructed by scaling the gain obtained by median filtering the gains of previous normal subframe. In addition, the pitch index is recovered using the pitch index of the final, subframe of the previous normal frame or the pitch indexes of the previous subframe of the N−1-the frame and the random values, and the gain is recovered by scaling the gain obtained by median filtering the adaptive codebook gain of the previous normal frame. The speech signal of the lost frame is reconstructed using the above recovered parameters. Meanwhile, in FIG. 3, bad frame indication (BFI) is information indicating whether the corresponding frame is a loss frame or a normal frame and when the BFI is 0, the corresponding frame is a normal frame, when BFI is 1, the corresponding frame is a loss frame. Here, normal frame means the frame which is received frame data without any data loss.

Figure 4:
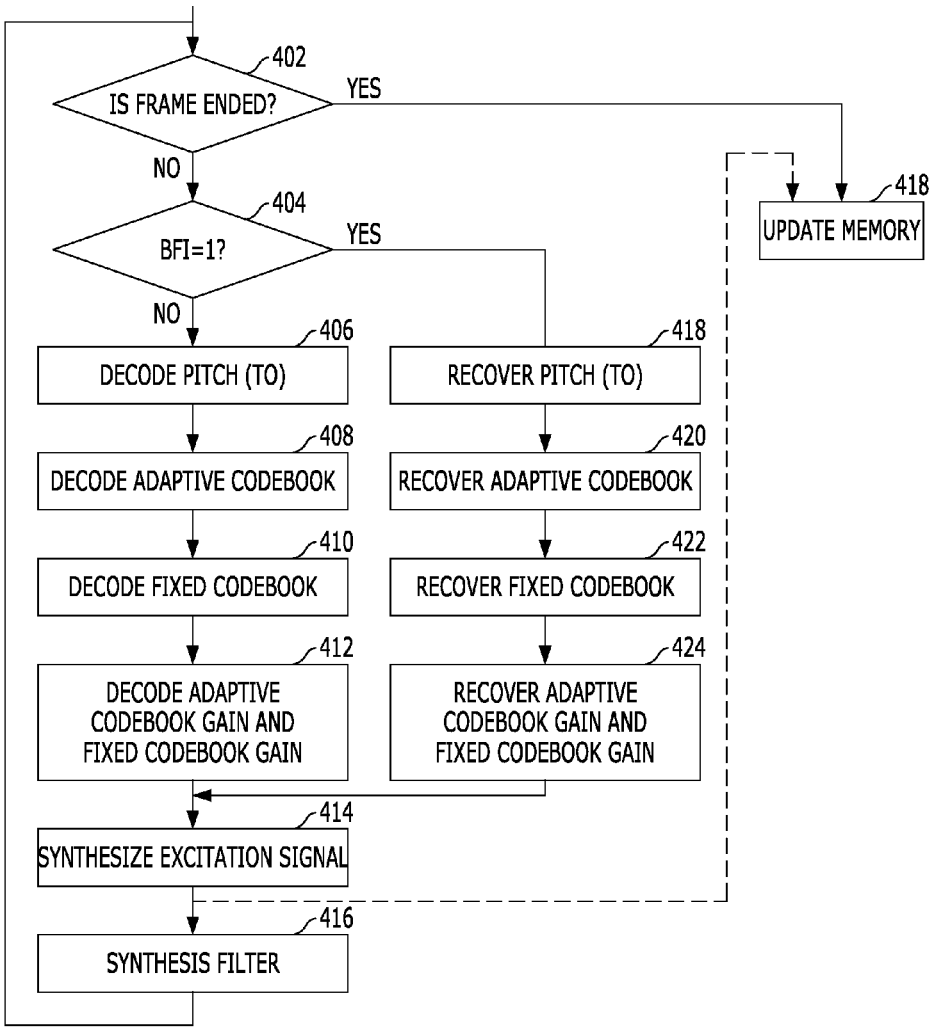
FIG. 4 is a flow chart illustrating a process of frame loss concealment in an AMR-WB codec.

FIG. 4 is a flow chart of an AMR-KB decoder illustrating a process of recovering a signal of the lost frame.

Referring to FIG. 4, it is determined whether the corresponding frame is the loss frame, that is, whether the BFI is 1 (401).

When the frame loss occurs (that is, when the BFI is 1), the pitch index is recovered using the pitch index of the previous subframe (402) and the adaptive codebook is generated using the recovered pitch index (403). Further, the fixed codebook is recovered by using random function (404). And the adaptive codebook gain and the fixed codebook gain of the lost frame are recovered by using scaling and median filtering of the adaptive codebook gain and the fixed codebook gain of the previous normal frame (405), respectively. Then, the excitation signal is constructed by the recovered adaptive codebook, fixed codebook (407), and gains. Then, this excitation signal is filtered by the synthesis filter (408). The synthesis filter coefficient of the lost frame are recovered using the synthesis filter coefficient of the normal frame received just before the frame loss.

When the frame data loss occurs, the influence of the frame data, loss affects the quality of the next normal frame as well as the quality of the lost frame itself. Therefore, in order to reduce the quality degradation due to the frame loss, it is also important to recover the speech signal of the lost frame well. Thereafter, when frame data are normally received, it is also important to be rapidly recovered to the normal state.

In the embodiment of the present invention, the adaptive codebook of the final subframe of the lost frame is updated by using the pitch information of the normal frame first received after frame data loss, so as to be rapidly escape from the influence of the frame data loss.

Figure 5:
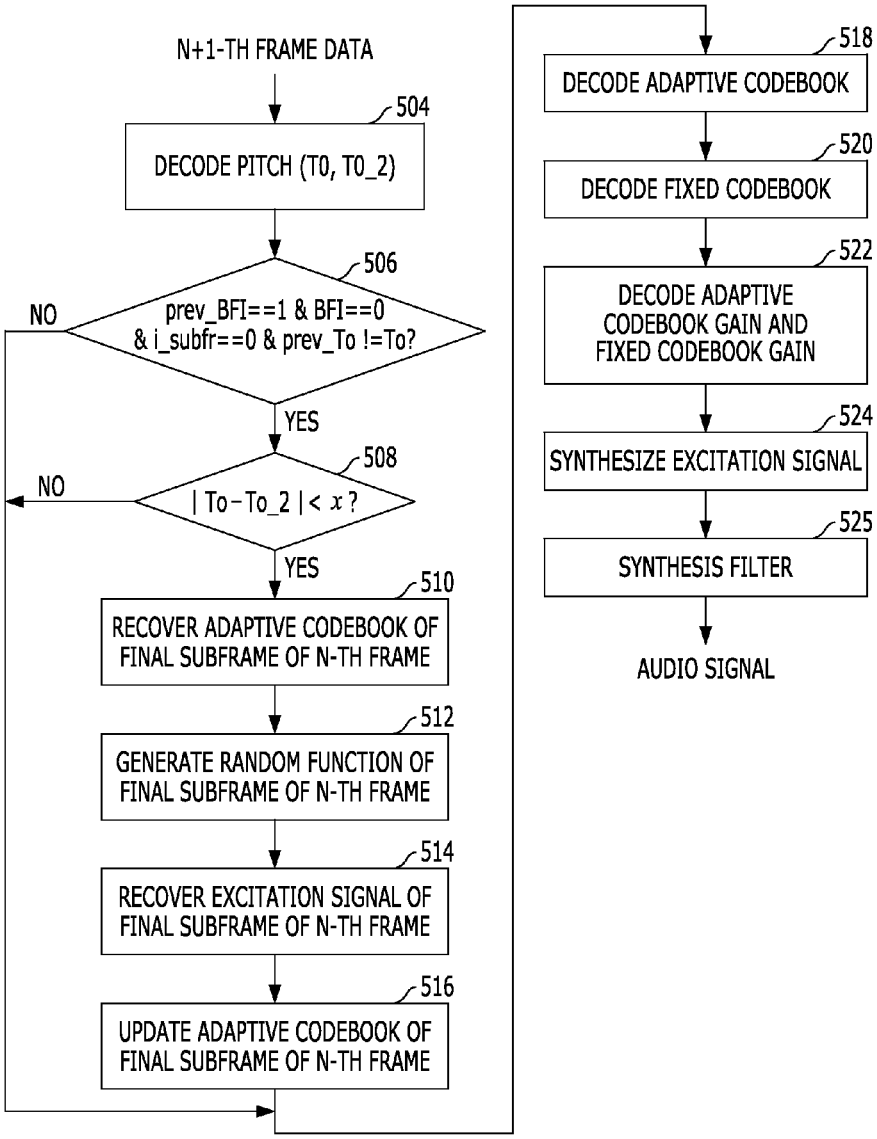
FIG. 5 is a flow chart illustrating a method for decoding a speech signal in accordance with an embodiment of the present invention.

FIG. 5 is a flow chart illustrating a method for decoding a speech signal in accordance with the embodiment of the present invention. The embodiment illustrates the process of synthesizing a signal of the N+1-th frame when the N-th frame data is lost. In the present invention, the adaptive codebook of the last subframe of N-th frame can be updated before synthesizing a signal of the N+1-th frame, when the N-th frame data is lost and N+1-th frame data is normaly received.

Referring to FIG. 5, a pitch T0 of the first subframe and a pitch T0_2 of the second subframe of the N+1-th frame data are first decoded (504).

Next, it is determined whether the N+1-th frame is the first normal frame received after frame loss (that is, prev_BFI==1 & BFI==0), the current subframe is the first subframe of the N+1-th frame (i_subr==0), and a recovered pitch PrevT0 of the final subframe of the N-th frame and the pitch T0 of the first subframe of the N—1-th frame are different from each other (prev_T0!=T0) (506). If one of the conditions is not satisfied, the general decoding procedure is performed after step 516.

If all the conditions of step 506 are satisfied, it is checked that an absolute value of the pitch difference (T0-T0-2) between the first subframe and the second subframe of the N+1-th frame is smaller than the predetermined reference value (x) (508). When the condition is not satisfied, the general decoding procedure is performed after step 516.

If the condition of step 508 is also satisfied, the adaptive codebook of the final subframe of the N-th frame is updated by using the first subframe pitch of the N+1-th frame before generate the excitation signal of the first, subframe of the N+1-th frame. That is, the adaptive codebook of the final subframe of the N-th frame is recovered by using the pitch index of the first subframe of the N+1-th frame (510) and the fixed codebook of the final subframe of the N-th frame is constructed using random function (512). Further, the excitation signal of the final subframe of the N-th frame is recovered (514) and the adaptive codebook of the final subframe of the N-th frame is updated (516).

Thereafter, the excitation signal of N+1-th frame are generated and then it is filtered by the synthesis filter. That is, the excitation signal of the corresponding subframe is constructed (526) by using the gains of each codebook (518) and the adaptive codebook (520) and the fixed codebook (522). The speech signal is recovered by filtering the excitation signal with synthesis filter (528). That is, in this invention, the adaptive codebook of the last subframe of the M-th frame is updated before constructing the excitation of N+1-th frame according to the results of 506 and 508.

Figure 6:
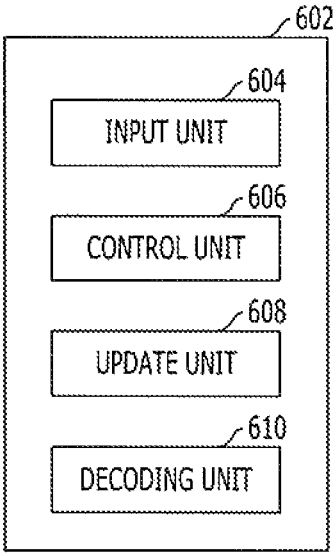
FIG. 6 is a diagram illustrating a configuration of an apparatus for decoding a speech signal in accordance with the embodiment of the present invention.

FIG. 6 is a diagram illustrating a configuration of an apparatus for decoding a speech signal in accordance with the embodiment of the present invention.

An apparatus 602 for decoding speech signal according to the embodiment of the present invention includes an input unit 604, a control unit 606, a update unit 608 and a decoding unit 610. The apparatus 602 may utilize a processor and a memory for storing instructions executable by the processor, where the instructions define processes of the input unit 604, the control unit 606, the update unit 608, and the decoding unit 610.

The input unit 604 receives the frame data which is output of the encoder. As described above, the frame data loss may occur during the transmission through network. In the embodiment of the present invention, the input unit 604 receives the N+1-th normal frame data after the N-th frame data loss.

The control unit 606 determines whether the adaptive codebook of the final subframe of the N-th frame is updated by using the parameters of the M-th frame and the N+1-th frame. And update unit (60S) update the adaptive codebook of the final subframe of the N-th frame by using the parameter of the N+1-th frame according to the result of the control unit 606.

In the embodiment of the present invention, the control unit 605 first decodes the first subframe pitch T0 and the second subframe pitch T0_2 of the N+1-th frame.

Next, the control unit 606 is determined whether the N+1-th frame is the first normal frame received after the frame data loss (that is, prev_BFI==1 & BFI==0), the current subframe is the first subframe of the N+1-th frame (i_subfr==0), and a pitch PrevT0 of the final subframe of the lost N-th frame and the pitch T0 of the first subframe of the N+1-th frame are different from each other (prev_T0 !=T0) (506). When the condition is not satisfied, the general decoding is performed after control unit 606.

If all of the conditions are satisfied, the control unit 606 check whether the absolute value of the pitch difference (T0-T0-2) between the first subframe and the second subframe of the N+1-th frame is smaller than the predetermined reference value (x) or not. When the condition is not satisfied, the the general decoding is performed after the control unit 606.

If the above conditions are satisfied, the update unit 608 updates the adaptive codebook of the final subframe of the N-th frame by using the first subframe pitch index of the N+1-th frame before the first subframe excitation signals of the N+1-th frame are constructed. That is, the update unit 608 generate an adaptive codebook of the last subframe of the N-th frame using the pitch index of the first subframe of the N+1-th frame and constructs a fixed codebook of the last subframe of the N-th frame using a random function. Further, the update unit 608 recovers the excitation signal of the final subframe of the N-th frame using recovered codebook parameters and updates the adaptive codebook of the final subframe of the N-th frame.

Thereafter, the decoding unit 610 synthesize the signal of the N+1-th frame. That is, the decoding unit 610 performs the decoding of the adaptive codebook and fixed codebook and decodes the adaptive codebook gain and fixed codebook gain. The decoding unit 610 synthesize the excitation signal of the corresponding subframe by using the decoded adaptive codebook and gain, and the fixed codebook and gain and then filtering the excitation signal with synthesis filter.

As described above, the embodiment of the present invention can more rapidly recover the decoder memory state to normal state by updating the adaptive codebook of the final subframe of the lost, frame by using the parameter of normal frame received after the frame data loss.

In addition, In accordance with the embodiment of the present invention, when the frame data is lost in a transition period from voiced to unvoiced sound or a period in which the pitch is changed, the influence of frame loss can be rapidly recovered, thereby reduce the quality degradation of the synthesis signal of normal frame received after frame loss.

As set forth above, the embodiments of the present invention can more rapidly return the decoder state to the normal decoder state by updating the adaptive codebook of the last subframe of the lost frame using the normally received frame data after the frame data loss.

While the present invention has been described with respect to the specific embodiments, it will be apparent, to those skilled in the art that various changes and modifications may be made without departing from the spirit and scope of the invention. Accordingly, the scope of the invention is not limited to exemplary embodiments as described above and is defined by the following claims and equivalents to the scope the claims.

What is claimed is:

1. A method for decoding a speech signal, comprising:

receiving an N+1-th normal frame data after an N-th frame data being lost;

determining whether to update an adaptive codebook of a final subframe of the N-th frame by using a parameter of the N+1-th frame;

wherein the determining comprises determining whether a difference between the pitch of the first subframe in the N+1-th frame and the pitch of the second subframe in the N+1-th frame is smaller than a predetermined reference value;

if the determination result is affirmative, updating the adaptive codebook of the final subframe of the N-th frame by using the parameter of the N+1-th frame; and synthesizing the Nth frame of the speech signal based on the updated adaptive codebook.

2. The method of claim 1, wherein the updating includes:

updating the adaptive codebook of the final subframe of the N-th frame by using the pitch index of the first subframe of the N+1-th frame.

3. The method of claim 1, wherein the synthesizing includes:

decoding of the updated adaptive codebook and fixed codebook; and decoding gain of the updated adaptive codebook and gain of the fixed codebook.

4. The method of claim 3, wherein the synthesizing includes:

synthesizing excitation signal of the corresponding N-th frame, by using the decoded updated adaptive codebook, the decoded gain of the updated adaptive codebook, the decoded fixed codebook, and the decoded gain of the fixed codebook; and filtering the synthesized excitation signal.

5. An apparatus for decoding a speech signal, the apparatus comprising:

a processor;

a memory for storing instructions executable by the processor, the instructions defining processes which include:

an input unit to receive an N+1-th normal frame data after an N-th frame data being lost;

a control unit to determine whether to update an adaptive codebook of a final subframe of the N-th frame by using a parameter of the N+1-th frame;

wherein the control unit determines by determining whether a difference between the pitch of the first subframe in the N+1-th frame and the pitch of the second subframe in the N+1-th frame is smaller than a predetermined reference value;

an update unit to, if the determination result is affirmative, update the adaptive codebook of the final subframe of the N-th frame by using the parameter of the N+1-th frame; and a decoding unit to synthesize the Nth frame of the speech signal based on the updated adaptive codebook.

6. The apparatus of claim 5, wherein the update unit updates the adaptive codebook of the final subframe of the N-th frame by using the pitch index of the first subframe of the N+1-th frame.

7. The apparatus of claim 5, wherein the decoding unit performs decoding of the updated adaptive codebook and fixed codebook, and decodes gain of the updated adaptive codebook and gain of the fixed codebook.

8. The apparatus of claim 7, wherein the decoding unit synthesizes excitation signal of the corresponding N-th frame, by using the decoded updated adaptive codebook, the decoded gain of the updated adaptive codebook, the decoded fixed codebook, and the decoded gain of the fixed codebook, and performs filtering of the synthesized excitation signal.

* * * * *